US006918211B2

(12) United States Patent
Nakano

(10) Patent No.: US 6,918,211 B2
(45) Date of Patent: Jul. 19, 2005

(54) DOOR CLOSING DEVICE

(75) Inventor: Hideki Nakano, Sakura (JP)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/438,454

(22) Filed: May 14, 2003

(65) Prior Publication Data

US 2003/0221370 A1 Dec. 4, 2003

(30) Foreign Application Priority Data

May 15, 2002 (JP) ..... 2002-139424

(51) Int. Cl.[7] ..... E05F 11/00; E05F 17/00; E05C 7/06

(52) U.S. Cl. ..... 49/360; 49/118

(58) Field of Search ..... 49/360, 324, 110, 49/118, 120, 123, 149–201; 187/309, 310, 330, 325, 321, 322, 328; 16/94 R, 49, 64

(56) References Cited

U.S. PATENT DOCUMENTS

| | | | | | |
|---|---|---|---|---|---|
| 3,756,585 | A | * | 9/1973 | Mihalcheon | 16/78 |
| 6,142,260 | A | * | 11/2000 | Shin | 49/360 |
| 6,164,014 | A | * | 12/2000 | McDowell et al. | 49/200 |
| 6,321,489 | B1 | * | 11/2001 | Murofushi et al. | 49/360 |
| 6,401,793 | B1 | * | 6/2002 | Martin | 49/200 |

* cited by examiner

*Primary Examiner*—Hugh B. Thompson, II

(57) ABSTRACT

A device for urging a door into a first position includes a spring apparatus (16) including a winding drum (22) having a conical outer peripheral surface (27) and a torsional spring (24) for imparting a relatively constant urging force to a cable 23 secured to the door in the direction of the first position.

7 Claims, 4 Drawing Sheets

FIG.3
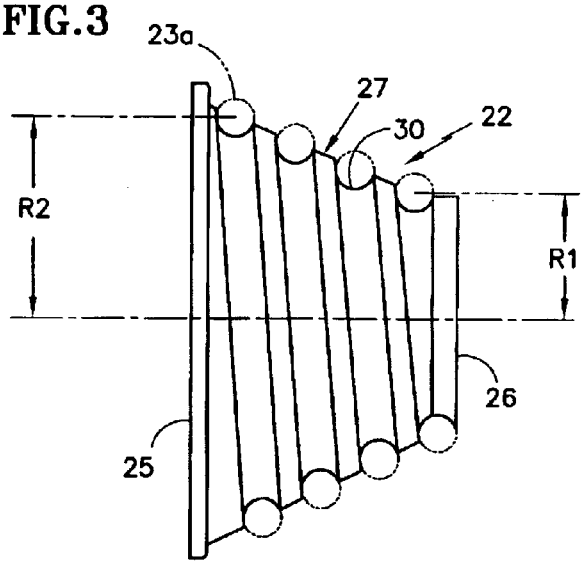
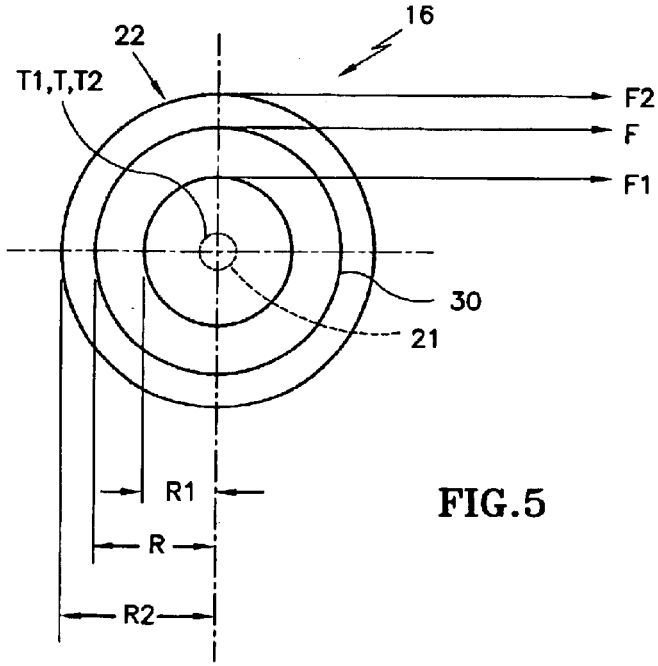
FIG.5
FIG.4
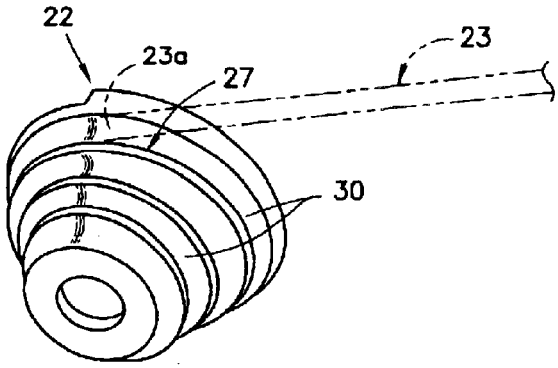

DOOR CLOSING DEVICE

FIELD OF THE INVENTION

The present invention relates to a device for urging a door into a closed or first position.

BACKGROUND

Devices for urging doors or the like into either closed or open positions are well-known in the art. It is frequently desired that a door should be kept in a closed position for safety, security or other reasons, and this is particularly true in elevator systems with respect to the landing doors.

In elevator systems, sliding doors are placed at each landing to secure the elevator hoistway during periods when the elevator car is not present at the landing. In this particular application, the mechanism for causing both the landing and car doors to open is mounted on the elevator car and moves vertically therewith. Upon arrival at a landing to be served, the elevator car doors and landing doors are engaged, and the opening mechanism drives both into the open position. Although this same mechanism also causes the doors to return to their closed positions upon completion of the loading and unloading of passengers, it is desirable that the landing doors include independent means or urging the doors into a closed position.

For space and other considerations, it is common to use a cable mechanism for driving the landing doors. One such mechanism known in the art utilizes a winding drum upon which the drive cable is wound and unwound as the door is slid closed and opened. A torsional spring, connected to the winding drum, provides an increasing torque on the drum as the cable, which is connected at one end to the landing door, is pulled off during opening. When the landing door is released, the spring winds the cable back on the drum, thereby pulling the landing door into the closed position.

One problem, however, with this prior art arrangement is that the torsional spring does not provide a uniform torque to the drum over the range of travel of the door. As will be apparent to those skilled in the art, a torsional spring will deliver the least torque when the door is in the closed or first position, and the most torque when the door is in the open or second position and the cable has been fully unwound from the winding drum. This variation in torque produces a similar variation in the restoring force imparted by the cable to the door. In order to open hoistway doors equipped with the torsional spring and cable apparatus of the prior art, it is necessary to provide a door opening mechanism with sufficient strength to overcome the highest force generated by the door closing apparatus. This results in a door opening mechanism which is much more powerful, heavier, and costly than desirable.

What is needed is a door closing device which provides a uniform closing force over the length of travel of the moving door, but which also retains the space and flexibility advantages of the prior art winding drum and cable device.

BEST MODE FOR CARRYING OUT THE INVENTION

According to the present invention, an apparatus for driving a door to a first, closed position from a second, open position includes a cable, attached at one end to the door and at the other end to a spring apparatus for pulling the door toward the first position. The spring apparatus includes a winding drum with a conical outer peripheral surface, whereby the cable is wound up on a progressively decreasing diameter surface as the door is pulled to the first position. A torsional spring drives the winding drum, imparting the greatest torsional force when the cable is fully unwound, and the least torsional force when the cable is fully wound and the door is in the first, closed position.

By matching the increasing diameter of the cable winding point on the winding drum with the correspondingly increasing torque imparted by the torsional spring, the apparatus according to the present invention provides a consistent linear urging force to the cable and door in the direction of the first position.

This arrangement is particularly useful for horizontally sliding landing doors in an elevator application, wherein it is desirable to provide a closing bias to the landing doors independent of the door opening and closing mechanism mounted on the elevator car. The apparatus according to the present invention achieves the flexibility and compactness of the prior art spring driven cable systems, but without requiring increased power to open the landing doors against an increasing spring resistance.

BRIEF DESCRIPTION OF THE DRAWINGS

FIG. 3 is a side view illustrating the winding drum of the present invention.

FIG. 4 is an oblique view illustrating the winding drum of the present invention.

FIG. 5 is a front view of the winding drum of the present invention.

DETAILED DESCRIPTION

Figure 6:
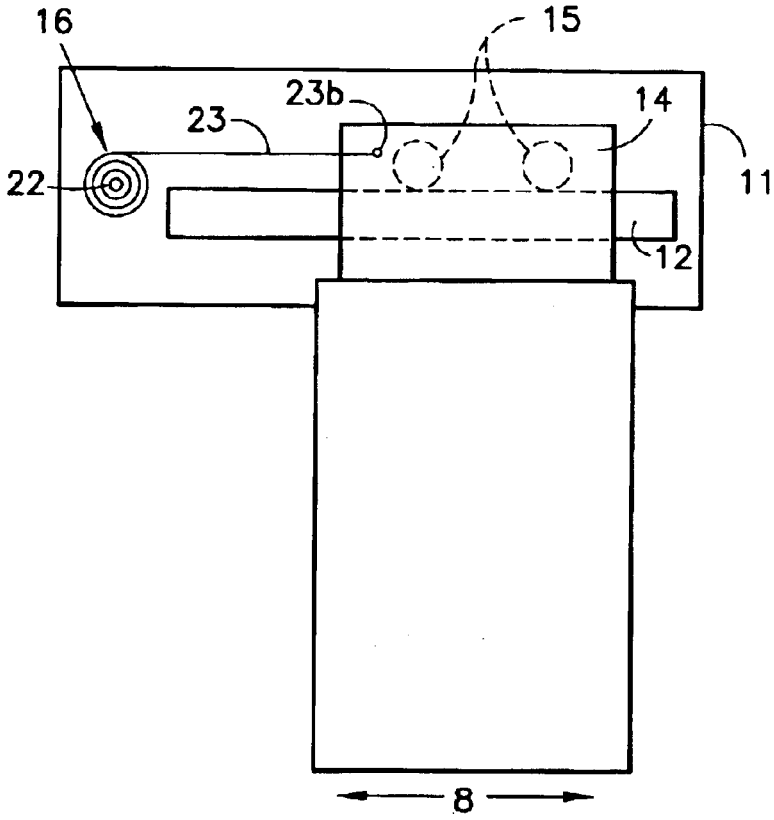
FIG. 6 is a plan view illustrating a first embodiment of the spring apparatus in relation to the car door.
Figure 7:
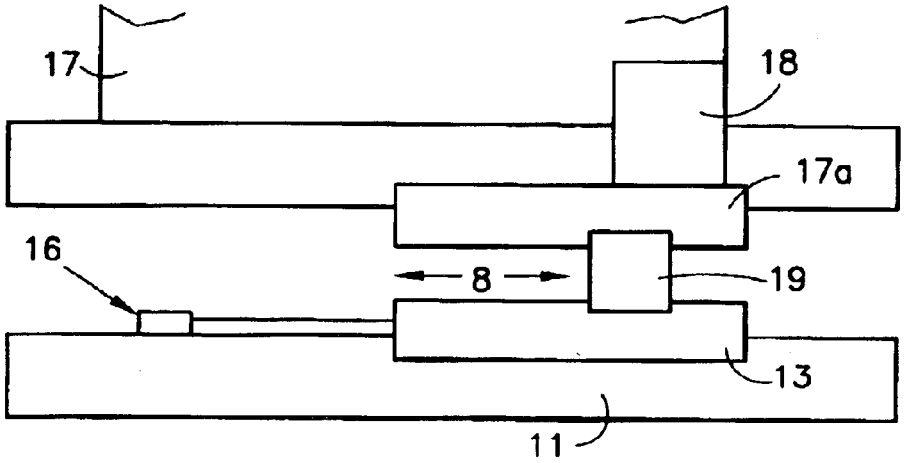
FIG. 7 is a plan view illustrating the relationship between the car door and landing door.

Referring to the drawing figures, and in particular to FIG. 6, an arrangement of the apparatus according to the present invention in an elevator application will be described. FIG. 6 shows an elevator landing door 13 including a hanger bracket 14 with supporting rollers 15 mounted therein. The rollers 15 ride on a horizontal track 12 which is secured to a door header 11 as shown in the figure. FIG. 7 shows a plan view of the door 13 with an elevator car 17 positioned at the landing, and the elevator car door 17*a* engaged with the landing door 13 by means of a releasable interlock 19. The interlocked doors 17*a* and 13 are moved laterally 8 by means of a door operator 18 as is well-known in the art.

According to the present invention, a spring apparatus 16 is secured to the door header 11 for pulling a cable 23 attached to the hanger bracket 14 at 23*b*. The spring apparatus 16 includes a winding drum 22 for winding and unwinding the cable 23 as the landing door 13 is moved laterally.

Figure 2:
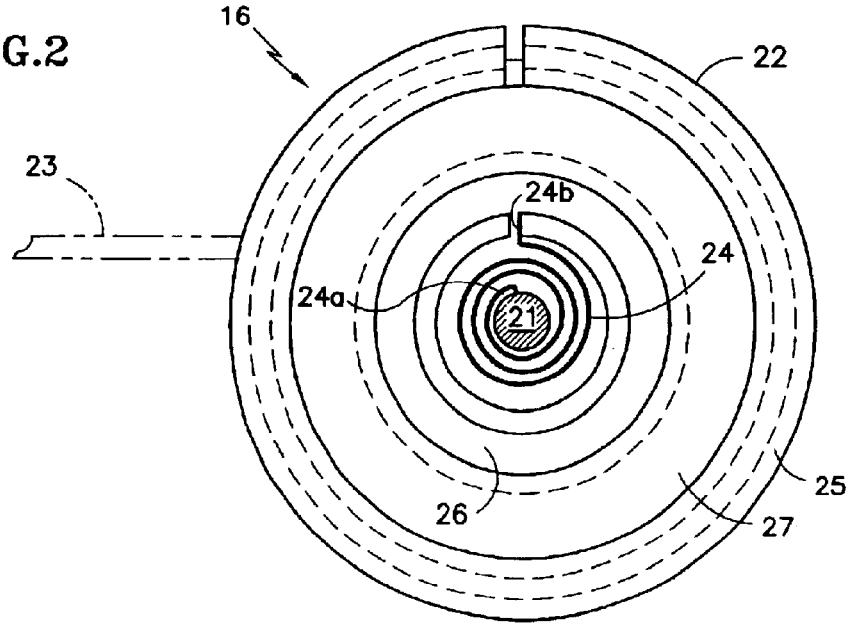
FIG. 2 is a view along A—A in FIG. 1.

Referring now to FIG. 2, a schematic view of the spring apparatus 16 shows the winding drum 22 with an outer peripheral surface 27, mounted so as to rotate about a central axis 21. The spring apparatus 16 further includes a spiral spring 24 secured at a first inner end 24*a* to the axle 21, and at a second outer end 24*b* to the winding drum 22. Thus, as winding drum 22 rotates in response to the unwinding of the cable 23, the spiral spring 24 will be deformed. The opposing torque delivered by the spring 24 to the winding drum 22 will cause a tension in the cable 23, thereby providing a restoring or returning force to the landing door 13.

Figure 1:
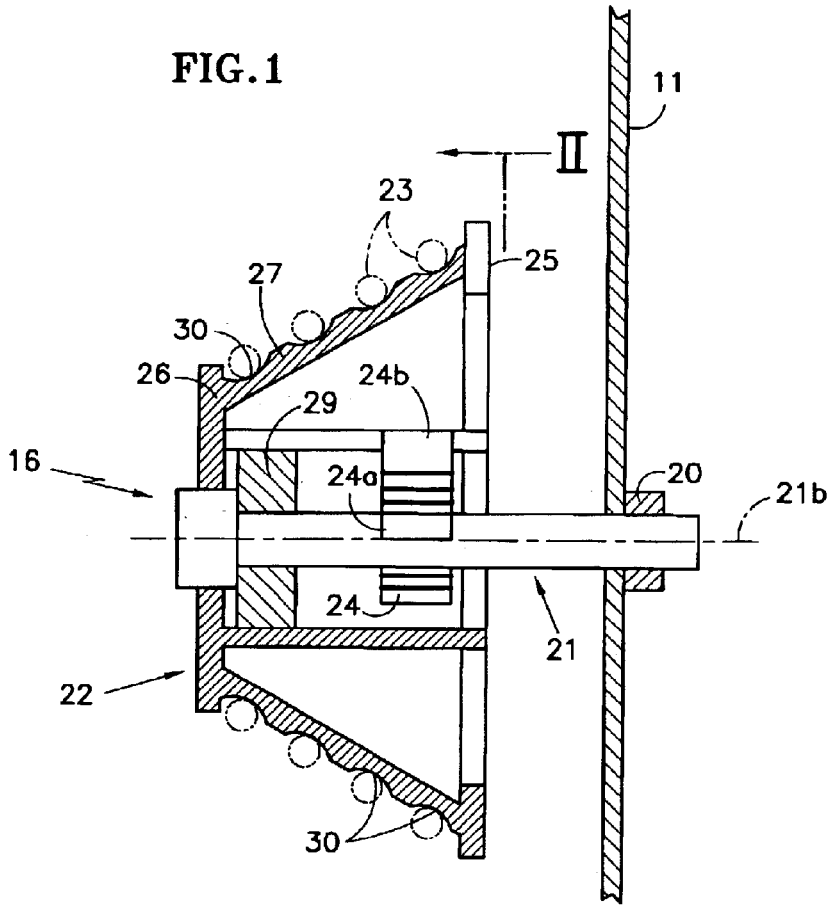
FIG. 1 is a longitudinal cross-sectional view illustrating the spring apparatus of the present invention.

Referring to FIG. 1, additional details of the spring apparatus 16 may be seen in the cross-section shown. The outer peripheral surface 27 of the winding drum 22 is conical in form, having an outer diameter which tapers inwardly with displacement along the axis 21*b* from one maximum diameter end 25 of the drum 22 to the other, minimum diameter end 26. As can be seen in the figure, the cable 23 is wound over the decreasing diameter outer peripheral surface 27. Thus, when the maximum quantity of cable 23 is wound on the winding drum 22, the cable is at the minimum diameter end 26 of the drum 22.

Also shown in FIG. 1 are guiding grooves 30 in the outer peripheral surface 27 for receiving the cable 23 as it is wound onto the winding drum 22. The guiding grooves 30 serve to position the cable 23, ensuring smooth operation of the invention. The grooves 30 and wound cable 23 form a spiraling helix over the outer peripheral surface 27 as most clearly shown in FIGS. 3 and 4.

The operation of the apparatus according to the present invention should now be apparent. The apparatus operates to urge a bidirectional moving door, such as an elevator landing door 13 in a first direction toward a first position by imparting a tension force on a cable 23 connected at a first end 23*b* to the door 13 and at the second end to a spring apparatus 16. The spring apparatus 16 imparts a constant tension force on the cable 23 by means of the interaction between the spiral spring 24 and the conical outer peripheral surface 27 as described above. As will be apparent to those skilled in the art, when the cable 23 is fully wound on the winding drum 22, the cable is positioned at the smaller or minimum diameter end 26. Simultaneously, the spiral spring 24 is in its least deformed configuration, whereby it exerts a minimum torsional force on the winding drum 22.

As the cable 23 is pulled from the drum 22 by the motion of the door 13 from the first position to a second position, the drum 22 rotates, whereby spiral spring 24 is deformed. Thus, as the cable is pulled from the increasing diameter portions of the outer peripheral surface 27, the torsional force exerted on the winding drum 22 by the spiral spring 24 likewise increases. As is most clearly shown in FIG. 5, the force F exerted on the cable 23 is equal to the torque T exerted by the spiral spring 24 divided by the lever arm R which is equal to the current radius of the cable 23 on the outer peripheral surface 27.

Thus, for the door 13 in the first position whereby the maximum quantity of cable 23 is wound on the winding drum 22, the force $F_1$ is determined by the torque $T_1$ divided by the radius $R_1$. As has been noted above, both $T_1$ and $R_1$ are at their minimum values, and both T and R increase as the cable 23 is unwound from the drum 22. Thus, in the second or fully open position of the door 13, the cable 23 is fully unwound from the drum 22 and $T_2$ and $R_2$ are at their maximum values. By judiciously sizing the spring 24 and the shape of the conical outer peripheral surface 27 of the winding drum 22, the force exerted on the cable 23 can be kept relatively constant.

Figure 8:
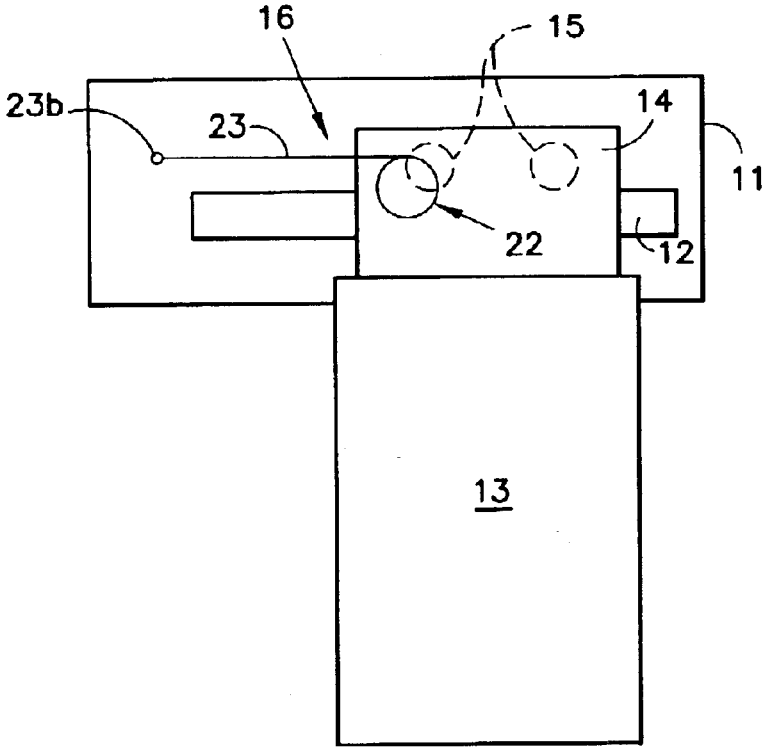
FIG. 8 is a plan view illustrating the door device of an alternate embodiment of the spring apparatus in relation to the car door.
Figure 9:
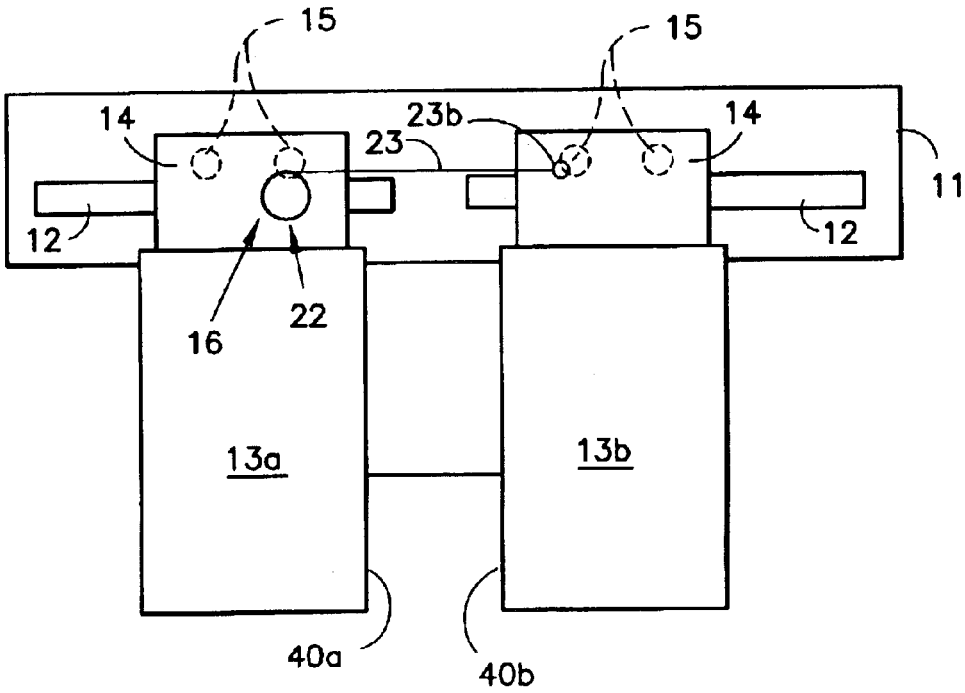
FIG. 9 is s plan view illustrating the door device of another alternate embodiment of the spring apparatus is relation to the car door.

FIGS. 8 and 9 show alternative arrangements for the door closing device according to the present invention. The embodiment shown in FIG. 8 operates similarly as compared to the embodiment discussed hereinabove, save that the spring apparatus 16 is mounted on the door hanger bracket 14, rather than on the fixed header 11, with the other end of the cable 23 being secured now to the header 11 at point 23*b* rather than to the door hanger 14.

FIG. 9 shows the apparatus according to the present invention as it might be installed in a double door arrangement wherein two hoistway doors are used. In this arrangement, the spring apparatus 16 is mounted on the door hanger bracket 14 of the first door 13*a*, while the one end of the cable 23 is secured to the door hanger bracket 14 of the second hoistway door 13*b*. As the doors move from a closed, first position wherein the facing edges 40*a* and 40*b* are abutting to an open, second position for permitting passengers to move between the landing and the elevator car, the cable 23 is unwound from the winding drum 22. The doors 13*a* and 13*b* are then urged into the closed position by the force imparted to cable 23 by the winding drum 22 and spiral spring 24 as discussed above.

It will be readily apparent to those skilled in the art that there are a number of equivalent embodiments or arrangements which although not directly illustrated here are within the scope of the invention. For example, although the apparatus according to the present invention has been shown in an elevator arrangement with one or more sliding doors, the invention may be equally applicable to swinging or lifting doors. Likewise, although shown here as functioning to urge the subject door or doors into a closed position, the invention may be used to bias or urge a door into an open position if so desired.

What is claimed is:

1. An apparatus for urging a bidirectionally moving door (13) in a first direction, comprising:

a cable (23), having a first end (23*b*) adapted to be attached to said door and oriented so as to deliver a tensile force thereto in said first direction;

a spring apparatus (16), engaged with said cable, for imparting the tensile force thereto, said spring apparatus further comprising;

a winding drum (22) having an outer peripheral surface (27) upon which said cable is wound; and, a torsional spring (24), engaged with said winding drum, wherein said torsional spring imparts a least magnitude torque (T1) to the winding drum when the moving door is at a first ultimate displacement nearest the drum in said first direction, and imparts a maximum magnitude torque ($T_2$) to the winding drum when the moving door is at a second ultimate displacement furthest from the drum in a second direction opposite said first direction, wherein said outer peripheral surface is shaped to impart a substantially constant force to said cable as said cable is wound onto said winding drum.

2. The apparatus as recited in claim 1, wherein the outer peripheral surface of the winding drum is conical in form whereby the outer diameter tapers inwardly with axial displacement from one end of the drum (25) to the other end of the drum (26).

3. The apparatus as recited in claim 2, wherein a second end (23*a*) of said cable is attached to the outer peripheral surface of the winding drum, and wherein said cable is wound circumferentially over the outer peripheral surface, whereby the maximum quantity of cable is wound thereon when the moving door is at the first ultimate position.

4. The apparatus as recited in claim 3, wherein the least quantity of said cable is wound on the outer peripheral surface when the moving door is at the second ultimate position.

5. The apparatus as recited in claim 4, wherein the second end of said cable is attached to the outer peripheral surface at the one, larger diameter end of the winding drum, and said cable is wound on the tapering diameter outer peripheral surface.

6. The apparatus as recited in claim 2, further comprising a guide groove (30), disposed on the outer peripheral surface, for receiving said cable wound onto the winding drum.

7. A device for urging a door (13) movable toward a first closed position from a second open position, comprising:

a cable (23) adapted to be secured at one end **(23*b*)** thereof to the door for pulling the door toward the first position;

a winding drum (22) having a conical outer peripheral surface (27) tapering diametrically in the axial direction **(21*b*)**;

whereby the other end **(23*a*) of the cable is secured to the outer peripheral surface at the largest diameter thereof and whereby the cable is wound onto the outer peripheral surface with movement of the door from the second position furthest away from the drum to the first position nearest to the drum, and a torsional spring (24)**, engaged to the winding drum for imparting increasing torque (T) to the winding drum as the cable is pulled from the drum by movement of the door toward the second position.

* * * * *